US005302052A

United States Patent [19]

Agustsson et al.

[11] Patent Number: 5,302,052

[45] Date of Patent: Apr. 12, 1994

[54] UNDERGROUND WORK CHAMBER ASSEMBLY AND METHOD FOR THE CONSTRUCTION THEREOF

[75] Inventors: Agust Agustsson, Redondo Beach; Richard A. Wallers, Balboa Island; Tomas H. Agustsson, Rolling Hills Estates, all of Calif.

[73] Assignee: Groundtech, Inc., Redondo Beach, Calif.

[21] Appl. No.: 48,479

[22] Filed: Apr. 16, 1993

[51] Int. Cl.[5] ..... E21D 11/10

[52] U.S. Cl. ..... 405/133; 405/8; 405/148; 405/150.1

[58] Field of Search ..... 405/8, 132, 133, 137, 405/148, 150.1

[56] References Cited

U.S. PATENT DOCUMENTS

| | | | |
|---|---|---|---|
| 175,158 | 3/1876 | Pontez | 405/8 |
| 1,049,528 | 1/1913 | Pepper . | |
| 1,495,352 | 5/1924 | O'Toole | 405/133 X |
| 3,307,361 | 3/1967 | Waterman . | |
| 3,527,294 | 9/1970 | Weiss et al. . | |
| 3,713,488 | 1/1972 | Ellenburg . | |
| 3,807,514 | 4/1974 | Murrell . | |
| 4,055,224 | 10/1977 | Wallers . | |
| 4,254,994 | 3/1981 | McBride . | |
| 4,480,697 | 11/1984 | Goldaniga et al. . | |
| 4,848,459 | 7/1989 | Blackwell et al. . | |
| 5,000,264 | 3/1991 | Snider . | |

FOREIGN PATENT DOCUMENTS

| | | | |
|---|---|---|---|
| 0111724 | 9/1981 | Japan | 405/8 |

*Primary Examiner*—David H. Corbin
*Attorney, Agent, or Firm*—Price, Gess & Ubell

[57] ABSTRACT

An underground work chamber assembly including a chamber, elevator shaft, air path, utility path, and slotted grout pipes which is assembled as lowered into a drilled hole on dry land or underwater, the slotted grout pipes facilitating a controlled grouting of the space surrounding the underground work chamber assembly when in place.

17 Claims, 6 Drawing Sheets

UNDERGROUND WORK CHAMBER ASSEMBLY AND METHOD FOR THE CONSTRUCTION THEREOF

BACKGROUND OF THE INVENTION

1. Field of the Invention

The present invention relates to underground work chambers and, more particularly, pertains to an underground work chamber assembly and a method for constructing such an underground work chamber.

2. Description of Related Art

The art is generally cognizant of underground work chambers and of the drilling techniques utilized during exploration for oil, natural gases, and precious metals. Representative prior art in the field of underground work chambers is included below.

W. D. Waterman, U.S. Pat. No. 3,307,361, describes a method of constructing an underground structure.

S. Pepper, U.S. Pat. No. 1,049,528, discloses a well digger's cage.

D. J. McBride, U.S. Pat. No. 4,254,994, teaches an apparatus for gaining access to an underground chamber.

In the mining industry, work chambers or cavities in the ground, typically connected by tunnels or shafts, are constructed "in place" by miners who mine out the chamber. In order to get to the chamber location, either a tunnel or shaft is utilized. In the case of men advancing by way of a tunnel, if the soil is unstable, shields, shotcrete lining and/or rock anchors must be used for men and equipment to advance to the chamber location. In the case of men advancing by shaft, the shaft is typically drilled using drilling fluid in order to bring up the cuttings, stabilize the hole and to prevent the migration of gases. Thereafter, steel casing is installed in the shaft and grouted in place for the men to enter the shaft in order to mine the chamber.

In order to mine a chamber in potentially unstable ground conditions, workers may use a variety of shoring techniques to prevent collapse, including spilling. Shields may be utilized. In relatively stable ground, rock bolts will dot the chamber wall which supports the wire mesh or steel reinforcing and shotcrete lining. Additionally, potential gas hazards must be addressed with the men working in the confined environment. A ventilation shaft must be installed from the surface. Once a cavity is excavated and made safe, the work space must be prepared to receive the tooling, equipment and materials to be used for the intended task.

These techniques all suffer from a number of disadvantages: Workers must enter the tunnel or shaft in order to create the chamber. While doing this, the workers are exposed to all the hazards of mining a cavity, whether it be unstable ground conditions or the dangers of migrating or trapped gases. The mining of a chamber is a time consuming process. The extraordinary safety precautions required when subjecting men to the hazards of mining chambers, plus the limited space for men, tools, equipment, and materials makes the process difficult and time consuming. Once the chamber is secured, it must be prepared for equipment, tooling, and utilities to function as a work space for its ultimate utilization. This process is performed with men within the chamber in a less than ideal work space.

OBJECTS AND SUMMARY OF THE INVENTION

An object is to provide an underground work chamber assembly which can be lowered into a hole bored into a ground surface which is on dry land or under water.

Another object is to provide an underground work chamber assembly including a chamber and an elevator shaft, air path, and at least one utility path, all of which are assembled from modular sections and connect the chamber positioned at the bottom of the hole to the ground surface.

Yet another object is to provide an underground work chamber assembly which includes a means for dispensing a cementitious material into the hole to shore the inside of the hole surrounding the chamber.

Still another object is to provide an underground work chamber assembly which includes a chamber with prepositioned internal attachments that do not interfere with any stiffening attachments external to the chamber.

Another object is to provide a method for constructing the aforementioned underground work chamber assembly wherein the elevator shaft, air path, and at least one utility path are safely and reliably assembled at the ground surface as the underground work chamber assembly is lowered into the hole.

Still another object is to provide a method for constructing the aforementioned underground work chamber assembly wherein the chamber's dispensing means permits assemblers of the underground work chamber to shore the inside of the hole surrounding the chamber with a high-strength cementitious material while the remainder of the hole may be filled with a lower-strength cementitious material.

The underground work chamber assembly includes a chamber, elevator shaft, air path, at least one utility path, and slotted grout pipes for dispensing a cementitious material into the hole above which the underground work chamber assembly is assembled and into which the underground work chamber is lowered thereafter. The method for constructing an underground work chamber requires drilling a hole into a ground surface, which may be on dry land or under water. The underground work chamber assembly is introduced into the hole by partially lowering the chamber into the hole so assemblers may connect the elevator shaft, air path, and utility path(s) to the chamber before the chamber is lowered too far. Assembly of the elevator shaft, air path, and utility path(s) occurs concurrently with the chamber being lowered into the hole, the elevator shaft, air path, and utility path being assembled by interconnecting elevator shaft sections, ventilation shaft sections, and utility pipe sections at the ground surface before the chamber is further lowered into the hole. When the chamber reaches the bottom of the hole, an elevator shaft, air path, and at least one utility path spans between the chamber and the ground surface. Once the chamber is in place, slotted grout pipes, which are attached to the chamber's exterior surface, are utilized to dispense a cementitious material into the hole. The cementitious material circumfuses the chamber and thereafter hardens, thereby filling the hole surrounding the chamber and sealing the chamber to the walls of the hole.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an underground work chamber assembly and method for the construction thereof.

Figure 1:
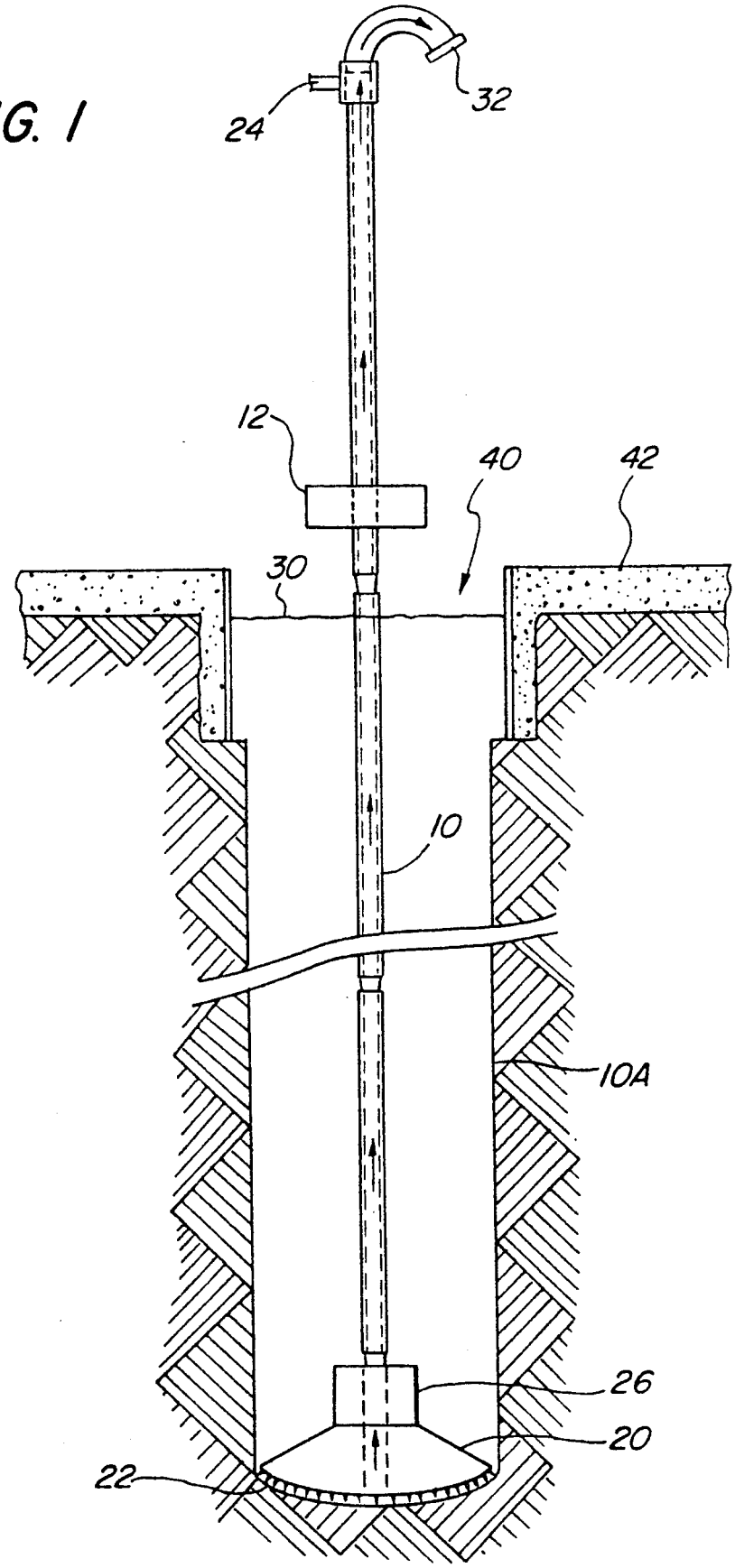
FIG. 1 is a schematic cross-section showing the drilling of a hole via implementation of a drill bit in an air-assisted reverse circulation drilling method.

FIG. 1 illustrates a dual wall drill pipe 10 including a drill bit 20 with side cutters 22. Rotary drive table 12 drives drill bit 20. Inject 24 provides air and drilling fluid 30 which are integral to drilling with the air-assisted reverse circulation method which uses drilling fluid 30 aerated by air to transport cuttings or spoils 32 to the surface. Drilling fluid 30 serves a number of purposes. In addition to assisting in transporting cuttings 32 to the surface, it provides a hydrostatic fluid head which supports the walls of hole 40 and provides lubrication to clean and cool bit cutters 22. Jet sub 26 injects air in inner drill pipe 10, which conveys air, fluid, and cuttings to surface 32.

Figure 2:
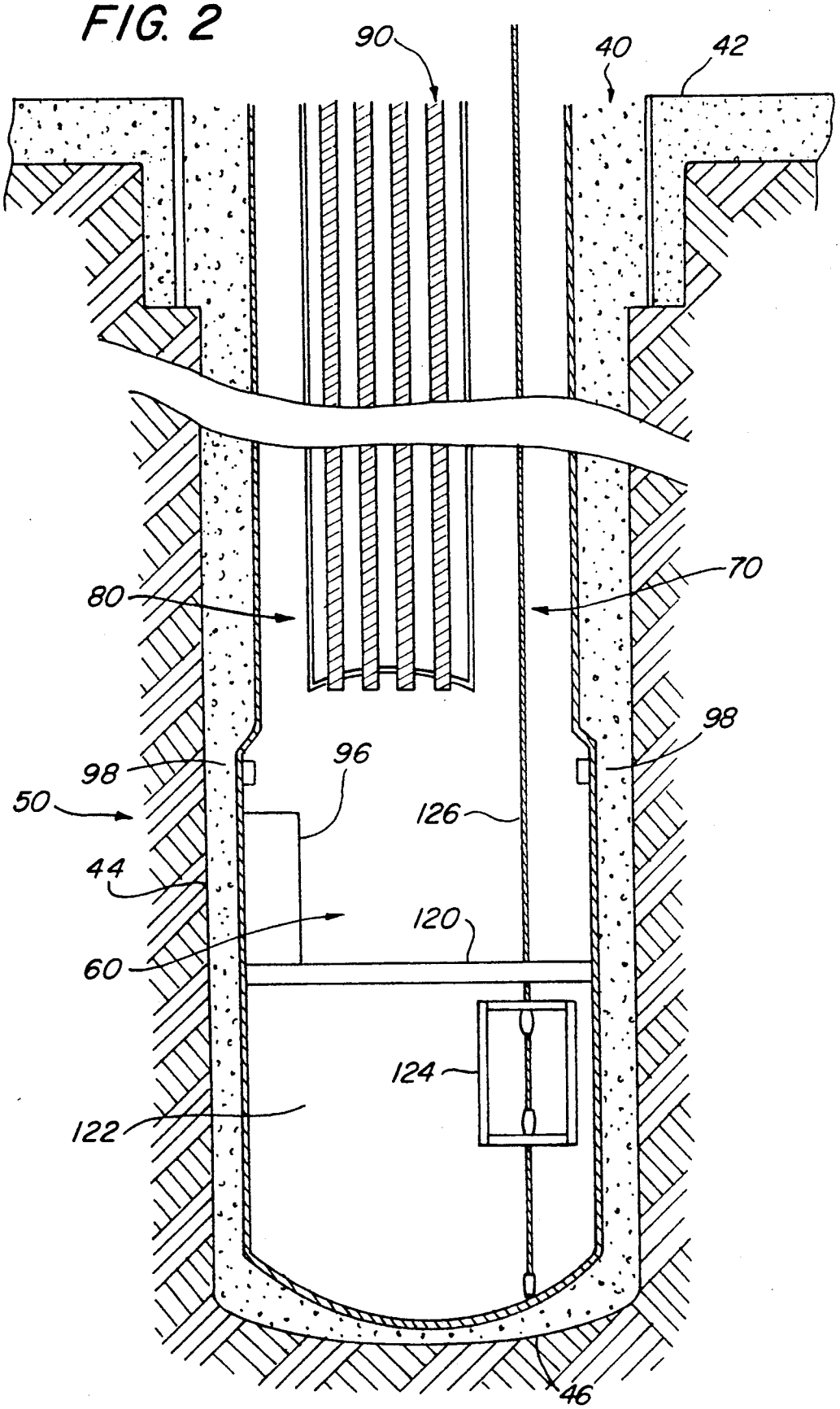
FIG. 2 is a schematic cross-section of an underground work chamber assembly which has been assembled and lowered to the bottom of a drilled hole.
Figure 5:
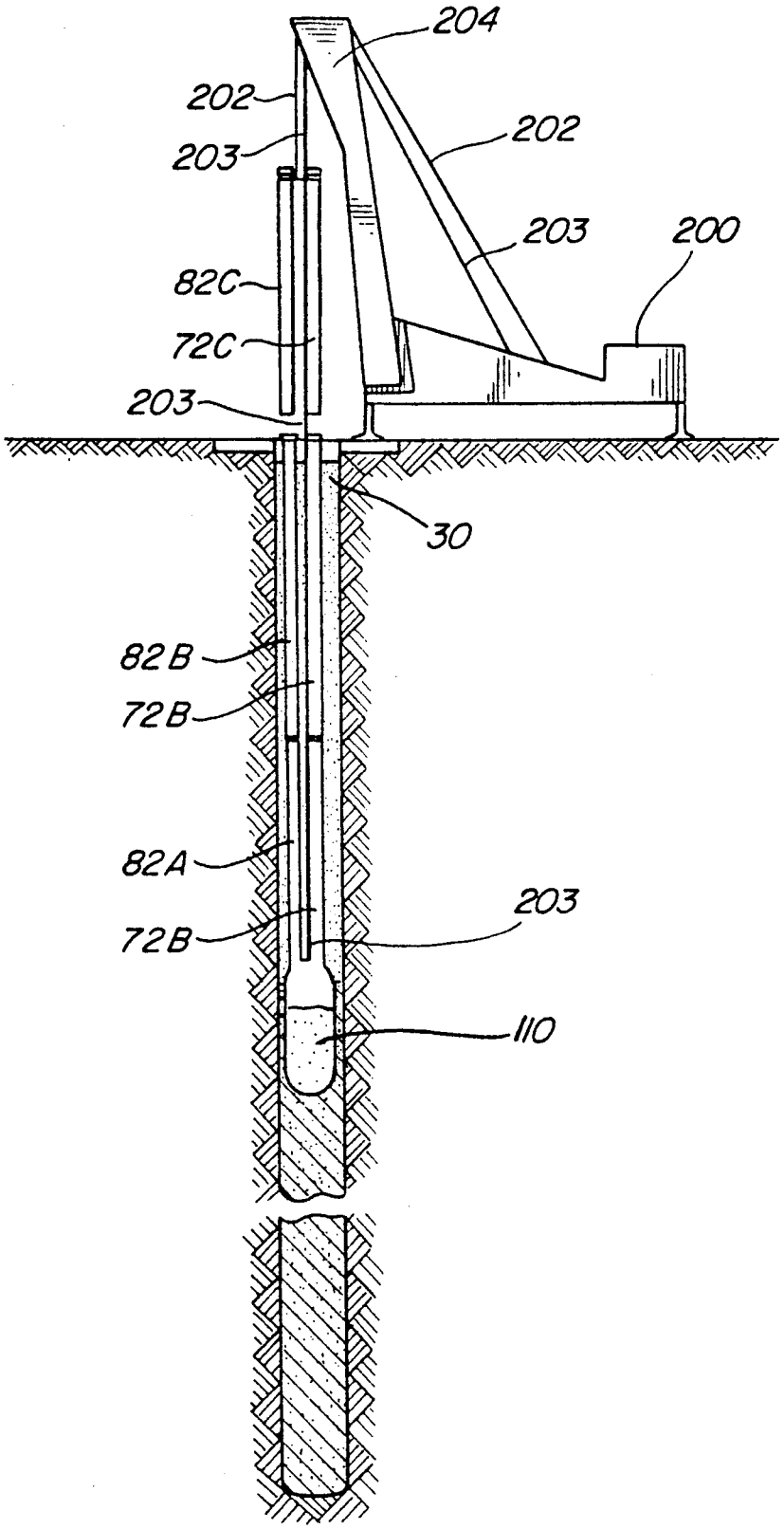
FIG. 5 is a cross-sectional, side view of an underground work chamber assembly being lowered into a drilled hole with elevator shaft and ventilation shaft sections being attached to the underground work chamber assembly as it is lowered into the hole.

FIG. 2 illustrates that hole 40 begins at ground level 42, continues downward along cylindrical interior surface 44, and ends at bottom surface 46. Underground work chamber assembly 50 includes chamber 60, elevator shaft 70, air path 80, and utility paths 90. When lowered to the bottom surface 46 of hole 40, elevator shaft 70 connects chamber 60 to ground surface 42. More specifically, and as seen in FIG. 5, elevator shaft 70 is formed by interconnecting a plurality of elevator shaft sections 72*a*, 72*b*, 72*c*. Obviously, the contemplated subject matter is not limited to only three elevator shaft sections 72. The number of elevator shafts necessary to span the distance between chamber 60 and ground level 42 depends upon the depth of hole 40 and the length of each elevator shaft section 72.

When lowered to bottom surface 46, chamber 60 is also connected to ground level 42 by air path 80 which spans the distance therebetween. Air path 80 is formed by interconnecting a plurality of ventilation shaft sections 82*a*, 82*b*, 82*c*, as illustrated in FIG. 5. Likewise, at least one utility path 90 provides a conduit for utilities between chamber 60 and ground level 42. Utility path 90 is formed by interconnecting a plurality of utility pipe sections (not shown).

Figure 3:
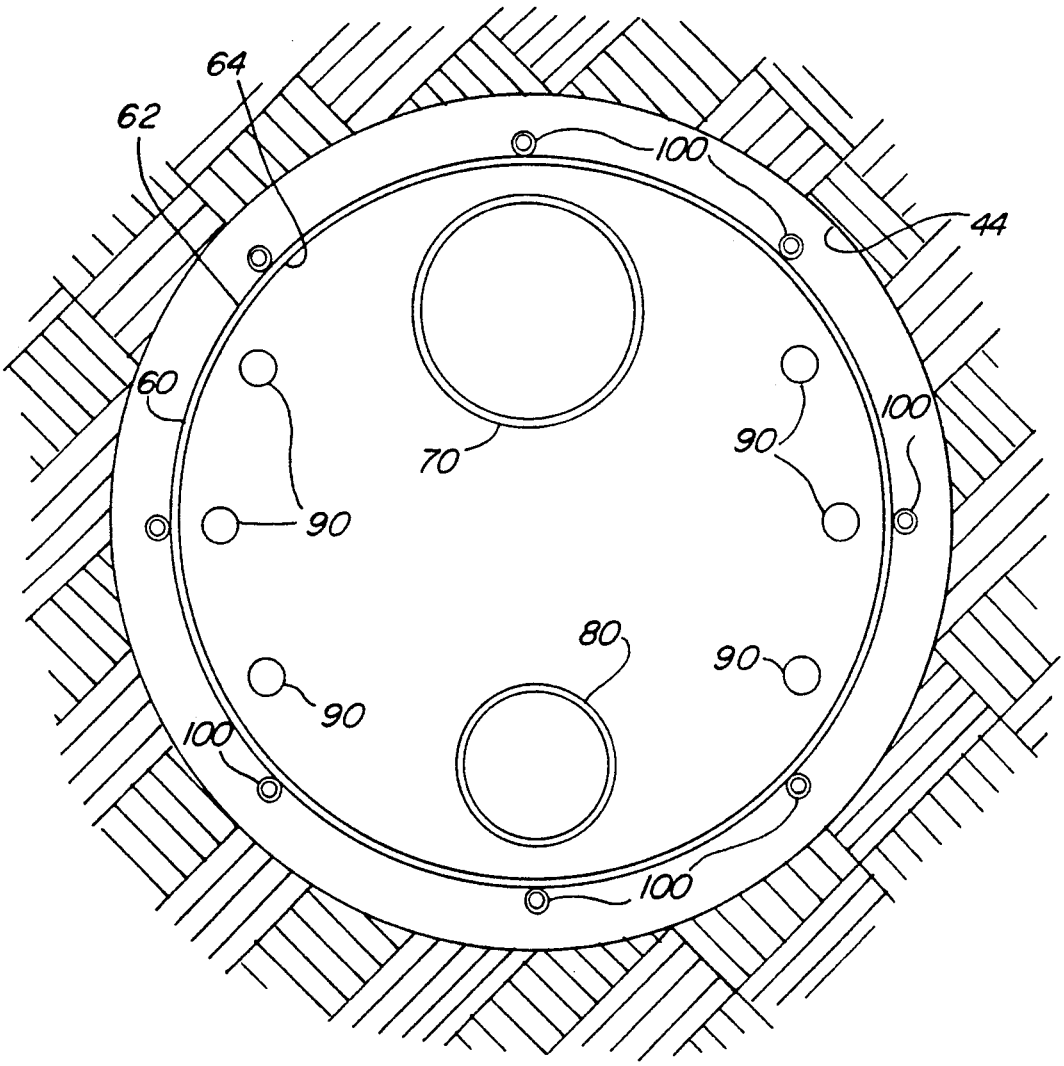
FIG. 3 is a cross-sectional, top view of the underground work chamber assembly.

FIG. 3 is a cross sectional, top view of chamber 60 and illustrates how elevator shaft 70, air path 80, and utility paths 90 are preferably positioned with respect to chamber 60. Chamber 60 includes exterior surface 62 and interior surface 64. A plurality of slotted grout pipes 100 are attached to exterior surface 62 before chamber 60 is lowered into hole 40. FIG. 2 shows that any internal attachments 96 (e.g., well heads) which might be attached to interior surface 64 are prepositioned such that they do not interfere with slotted grout pipes 100, stiffeners 98, and any other objects attached to either exterior surface 62 or interior surface 64. Although stiffeners 98 may be attached to exterior surface 62 as well as interior surface 64, stiffeners 98 are preferably secured to interior surface 64, with the exception of the slotted grout pipes 100 on exterior surface 62, which also serve as stiffeners 98.

FIG. 5 shows that chamber 60 is necessarily sized to fit within hole 40 so that chamber 60 may be lowered therein by a winch 200. First winch cable 202 is attached to a component of underground work chamber assembly 50 which is to be next attached to those components already interconnected and lowered into hole 40 by second winch cable 203, which is attached to chamber 60. Derrick 204 is positioned over hole 40 and supports first winch cable 202 and second winch cable 203 as the cables are released or retracted by winch 200 as required by the assembly operation.

Additionally, FIG. 5 shows that drilling liquid 30 may still remain in hole 40 while underground work chamber assembly 50 is constructed at ground level 42 and lowered into hole 40. The descent of underground work chamber assembly 50 is an incremental one. First, chamber 60 is partially lowered into hole 40 by second winch cable 203 such that elevator shaft section 72*a* and ventilation shaft section 82*a* may be connected to chamber 60 safely and reliably by workers positioned approximately at ground level 42. While chamber 60 is secured near ground level 42, winch 200 lowers elevator shaft section 72*a* and ventilation shaft section 82*a* over chamber 60 with first winch cable 202 so that the shaft sections may be connected thereto. Next, the entire underground work chamber assembly 50, consisting of interconnected chamber 60, elevator shaft section 72*a*, and ventilation shaft section 82*a*, is lowered into hole 40 by second winch cable 203 until the tops of elevator shaft section 72*a* and ventilation shaft section 82*a* are positioned near ground level 42 and above any drilling fluid 30. In a preferred embodiment, elevator shaft sections 72, ventilation shaft sections 82, and utility pipe sections (not shown) are all sized to be approximately a common length to minimize the number of times that winch 200 must pause while lowering underground work chamber assembly 50 into hole 40.

FIG. 5 specifically illustrates elevator shaft section 72*c* being lowered over elevator shaft section 72*b* and ventilation shaft section 82*c* being lowered over ventilation shaft section 82*b*. The elevator shaft sections, 72*b*, 72*c*, and the ventilation shaft sections, 82*b*, 82*c*, are preferably welded together or interconnected with flange bolts.

Chamber 60 is preferably made of steel, concrete, glass-reinforced plastic, or a combination of the aforementioned materials. Between exterior surface 62 and interior surface 64, chamber 60 may be of a single or dual wall construction. When drilling fluid 30 is utilized, chamber 60, elevation shaft 70, and air path 80 may be flooded with buoyancy fluid 110 to counteract the buoyancy of drilling fluid 30 and to reduce stresses on underground work chamber assembly 50 prior to the grouting of hole 40.

The underground work chamber assembly 50 may be utilized as a staging area or work area for any task requiring a safe working space, including the drilling of lateral holes for oil mining, cement or chemical grouting, haz-mat work, subsurface monitoring and testing or tunnel works. FIG. 2 shows a work deck 120 positioned within chamber 60. Below work deck 120 is storage space 122 which, like the portion of chamber 60 above it, is accessible by elevator 124 which is lowered down elevator shaft 70 and into chamber 60 by elevator cable 126.

Figure 4:
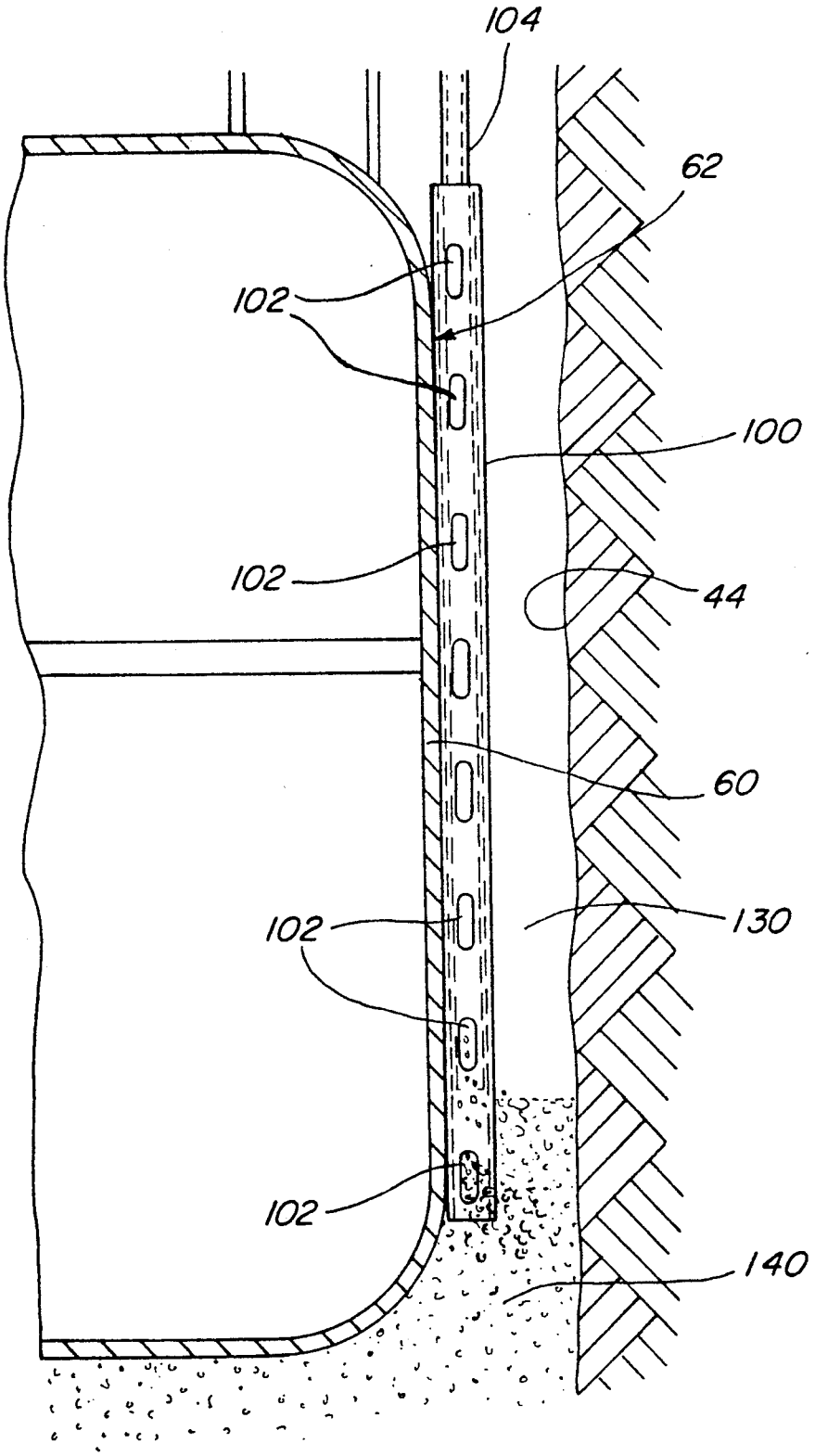
FIG. 4 is a partial cross-sectional, side view of the chamber and the slotted grout pipe attached thereto.
Figure 6:
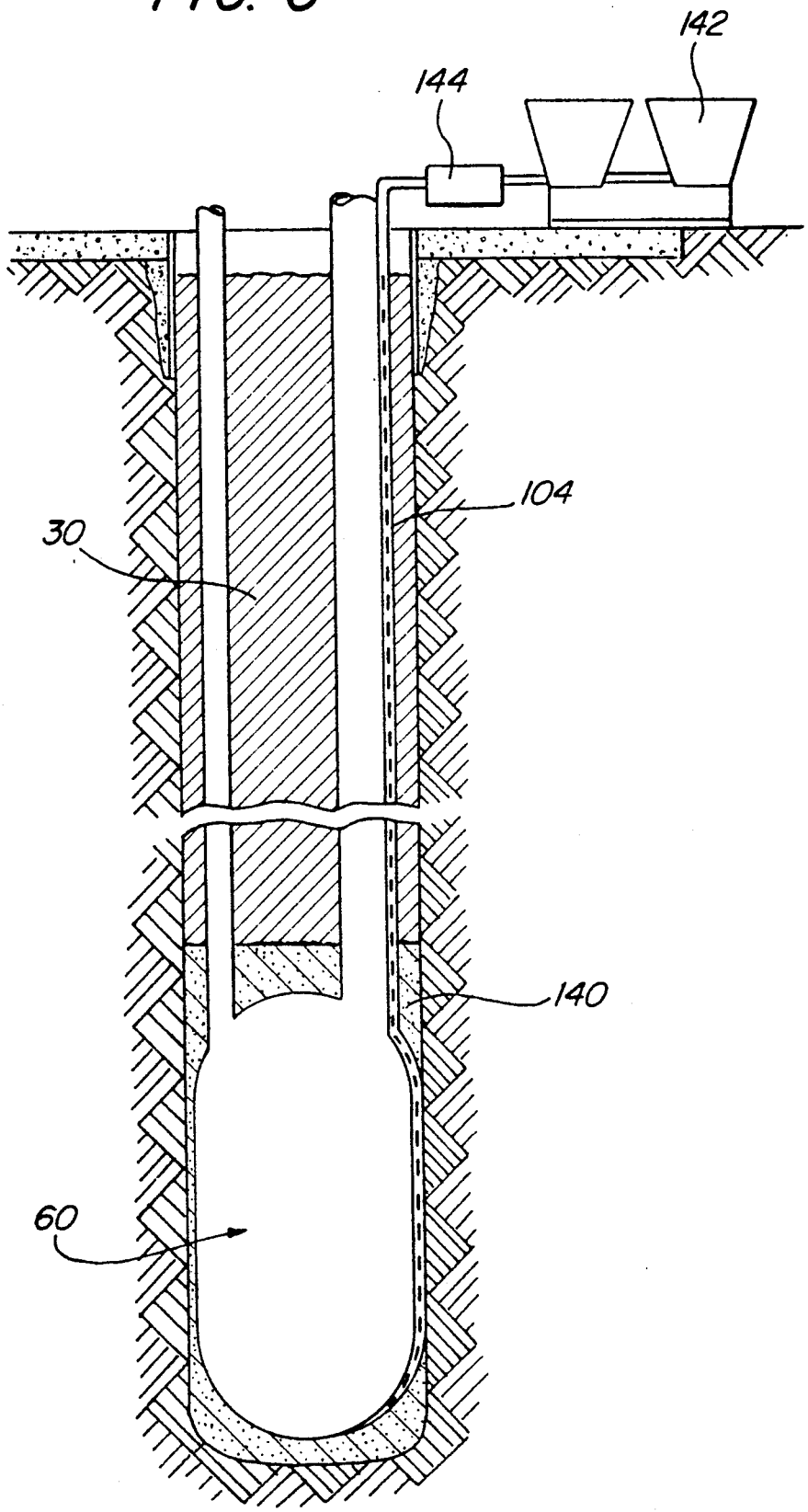
FIG. 6 is a cross-sectional side view of an underground work chamber assembly which has been lowered to the bottom of the drilled hole and is being circumfused by a cementitious material.

FIG. 4 and FIG. 6 illustrate how a slotted grout pipe 100 facilitates a controlled grouting of a volume 130 bounded by cylindrical interior surface 44 and exterior surface 62. Restated, volume 130 is the space surrounding chamber 60 and in between chamber 60's exterior surface 62 and the hole's cylindrical interior surface 44. Several purposes exist for dispensing a cementitious material 140 into hole 40. One is to secure chamber 60 within hole 40 by sealing voids around chamber 60 and the slotted grout pipes 100 attached thereto. Another is to provide support to cylindrical interior surface 44 which may be surrounded by ground composed of sand or other loose materials.

Slotted grout pipes 100 provide a means for dispensing a grouting or cementitious material 140 into volume 130. Although the cementitious material 140 performs a slight shoring function, as indicated above, chamber 60 is the principal source of support for cylindrical interior surface 44 and is designed to perform all of the shoring. The cementitious material 140 is dispensed from grout mixer 142, via grout pump 144, to dispensing pipes 104 which are sized to fit within slotted grout pipes 100. Dispensing pipes 104 slide within slotted grout pipes 100 so that the cementitious material 140 is dispensed from slots 102 on slotted grout pipes 100 from the bottom of hole 40 upward as dispensing pipes 104 are pulled upward through slotted grout pipes 100. Slots 102 are linearly arranged along the length of slotted grout pipes 100 and are positioned such that the cementitious material 140 passing through grout pipes 100 and out slots 102 will be radially directed outward from the exterior surface 62 of chamber 60. Accordingly, the cementitious material 140 circumfuses chamber 60, secures chamber 60 to bottom surface 46, and provides for greater quality assurance in grouting around chamber 60.

The cementitious material 140 surrounding chamber 60, in a preferred embodiment, is a higher-strength grout than that which is dispensed into the remaining portion of hole 40 above volume 130. In other words, a higher-strength grout 140 is first dispensed around chamber 60. After the higher-strength grout 140 hardens into a shoring mass which fills volume 130 and supports the cylindrical interior surface 44, the balance of hole 40 can be filled with a much weaker slurry mix or, in some cases, the drilling fluid 30 already present in hole 40 by recirculating and adding cement and other compounds to cure the drilling fluid 30 until the desired design mix is achieved.

After the grouting material 140 dispensed into hole 40 has cured, any buoyancy fluids 110 within underground work chamber assembly 50 may then be safely purged. The aforedescribed process for constructing an underground work chamber assembly 50 renders a prefabricated structure capable of withstanding buckling, collapse of the walls, and yielding of the material caused by the installation procedure, external pressures from the grouting operation, and external hydrostatic and/or lithostatic pressures exerted by the surrounding underground environment after the work chamber is installed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A method for constructing an underground work chamber comprising:

drilling a hole of a minimum diameter into a ground surface located either on land or underwater, the hole including a cylindrical interior surface and a bottom surface, the earth displaced to form the hole constituting spoils;

removing said spoils from said hole;

lowering an underground work chamber assembly into said hole, said underground work chamber assembly comprising:

a chamber sized to fit within said hole, said chamber including an exterior surface, said chamber being lowered to a position near said hole's bottom surface;

a plurality of elevator shaft sections interconnected to form an elevator shaft spanning between said chamber and said ground surface;

a plurality of ventilation shaft sections interconnected to provide an air path between said chamber and said ground surface; and a plurality of slotted grout pipe sections attached to said chamber's exterior surface and to a plurality of dispensing pipes; and dispensing a higher-strength cementitious material through said plurality of dispensing pipes, into said slotted grout pipe sections and out said slots of said slotted grout pipes, into a volume being bounded by said hole's interior surface and said exterior surface of said chamber, said higher-strength cementitious material substantially filling said volume, circumfusing said chamber's exterior surface, and thereafter hardening into a shoring mass, thereby filling said volume and supporting said hole's interior surface.

2. The method of claim 1, further including the step of removing any buoyancy fluids within said underground work chamber assembly after said cementitious material has cured.

3. The method of claim 1 wherein said drilling step is performed with a rotary cutter including side cutters.

4. The method of claim 1 wherein said removing step is performed by using a drilling liquid to transport said spoils from said hole.

5. The method of claim 1, further including the step of filling said hole above said chamber with a lower-strength cementitious material.

6. An underground work chamber assembly comprising:

a chamber sized to fit within a hole bored into a ground surface located either on land or underwater, said chamber having an exterior surface and an interior surface, said hole including a cylindrical interior surface and a bottom surface, said chamber being lowered to a position near said bottom surface;

a plurality of elevator shaft sections interconnected to form an elevator shaft spanning between said chamber and said ground surface;

a plurality of ventilation shaft sections interconnected to provide an air path between said chamber and said ground surface; and a plurality of slotted grout pipe sections attached to said chamber's exterior surface and a plurality of dispensing pipes, each of said slotted grout pipes including a plurality of slots which open radially outward from said chamber, each of said slotted grout pipes being sized to respectively receive one of said plurality of dispensing pipes through which a cementitious material is dispensed, each of said dispensing pipes respectively sliding within said slotted grout pipes to selectively dispense said cementitious material via said slots of said slotted grout pipes, said cementitious material substantially filling said volume, circumfusing said chamber's exterior surface, and thereafter hardening into a shoring mass, thereby filling said volume and supporting said hole's interior surface.

7. The underground work chamber assembly of claim 6 wherein said chamber is made from at least one of a group consisting of steel, concrete, and glass-reinforced plastic.

8. The underground work chamber assembly of claim 6 wherein said chamber is characterized by a single-wall construction.

9. The underground work chamber assembly of claim 6 wherein said chamber is characterized by a dual-wall construction.

10. The underground work chamber assembly of claim 6, further comprising means for stiffening said chamber, the stiffening means being mechanically connected to said chamber's interior or exterior surface, any internal attachments to said chamber's interior surface being prepositioned to avoid interference with the stiffening means.

11. The underground work chamber assembly of claim 6 wherein each of said elevator shaft sections and each of said ventilation shaft sections is approximately equal in length.

12. The underground work chamber assembly of claim 6 wherein said plurality of elevator shaft sections are interconnected with a plurality of flange bolts.

13. The underground work chamber assembly of claim 6 wherein said plurality of elevator shaft sections are welded together.

14. The underground work chamber assembly of claim 6 wherein said plurality of ventilation shaft sections are one of interconnected with a plurality of flange bolts.

15. The underground work chamber assembly of claim 6 wherein said plurality of ventilation shaft sections are welded together.

16. The underground work chamber assembly of claim 6 wherein said cementitious material is a bentonite cement slurry.

17. An underground work chamber assembly comprising:

a chamber sized to fit within a hole bored into a ground surface, said chamber being characterized by a single-wall construction having an exterior surface and an interior surface, said hole including a cylindrical interior surface and a bottom surface, said chamber being lowered to a position near said bottom surface;

a plurality of elevator shaft sections interconnected to form an elevator shaft spanning between said chamber and said ground surface;

a plurality of ventilation shaft sections interconnected to provide an air path between said chamber and said ground surface; each of said elevator shaft sections and each of said ventilation shaft sections being approximately equal in length;

a plurality of dispensing pipes;

a plurality of slotted grout pipe sections for dispensing a cementitious material into a volume bounded by said hole's interior surface and said chamber's exterior surface, said slotted grout pipe sections being attached to said chamber's exterior surface, each of said slotted grout pipes including a plurality of slots which open radially outward from said chamber, each of said slotted grout pipes being sized to respectively receive one of said plurality of dispensing pipes through which said cementitious material is dispensed, each of said dispensing pipes respectively sliding upward along said exterior surface, within said slotted grout pipes, while radially dispensing said cementitious material into said volume through said slots of said slotted grout pipes, said cementitious material substantially filling said volume, circumfusing said chamber's exterior surface, and thereafter hardening into a shoring mass, thereby filling said volume and supporting said hole's interior surface; and means for stiffening said chamber, said stiffening means being mechanically connected to said chamber's interior or external surface, any internal attachments to said chamber's interior surface being prepositioned to avoid interference with said stiffening means.

* * * * *